US006634047B2

(12) United States Patent
Rowland

(10) Patent No.: US 6,634,047 B2
(45) Date of Patent: Oct. 21, 2003

(54) TENT STAKE HAMMER, PULLER, AND GROUND PENETRATING DIBBLE

(76) Inventor: Jeffrey Lee Rowland, 1510 Awalt Ct., Los Altos, CA (US) 94024

( * ) Notice: Subject to any disclaimer, the term of this patent is extended or adjusted under 35 U.S.C. 154(b) by 0 days.

(21) Appl. No.: 09/846,713

(22) Filed: Apr. 30, 2001

(65) Prior Publication Data

US 2001/0032366 A1 Oct. 25, 2001

Related U.S. Application Data

(60) Provisional application No. 60/199,497, filed on Apr. 25, 2000.

(51) Int. Cl.[7] ..... B25D 1/04
(52) U.S. Cl. ..... 7/143
(58) Field of Search ..... 7/143, 146, 147, 7/114, 170; D8/14, 105, 88

(56) References Cited

U.S. PATENT DOCUMENTS

| | | | | |
|---|---|---|---|---|
| 373,663 A | | 11/1887 | Hyde | |
| 785,801 A | | 3/1905 | Davis | |
| 2,582,284 A | | 1/1952 | Sarosdy | |
| 3,823,430 A | | 7/1974 | Welsh, II | |
| 3,867,733 A | * | 2/1975 | Verlander | 7/146 |
| 4,112,530 A | | 9/1978 | Leece | |
| 4,198,719 A | | 4/1980 | Feldpausch | |
| D340,852 S | | 11/1993 | Sanders | |
| D395,808 S | | 7/1998 | Loucks | |
| 5,934,649 A | | 8/1999 | Drane | |

* cited by examiner

*Primary Examiner*—D. S. Meislin
(74) *Attorney, Agent, or Firm*—Jeffrey D. Moy; Harry M. Weiss; Weiss, Moy & Harris, P.C.

(57) ABSTRACT

A camping tool for hammering in and removing tent-stakes out of the ground, and also for making holes into the ground for the tent-stakes or for breaking up very hard ground. The tool can be split into two pieces for easier storage. This includes on the upper portion, the hammerhead (10) for hammering the tent-stakes into the ground and the ground-penetrating dibble (12) for either making the starter hole or breaking up hard ground. Also, on the lower portion is the leverage leg (14), which is used for removing the tent-stakes easier by using leverage power, and the o-ring (24) for attaching onto the tent-stakes so you can remove them. Both the o-rings and leverage leg are on the plastic cylindrical body-tube (16).

4 Claims, 2 Drawing Sheets

TENT STAKE HAMMER, PULLER, AND GROUND PENETRATING DIBBLE

CROSS-REFERENCE TO RELATED APPLICATIONS

This application claims the benefit of Provisional Patent Application Serial No. 60/199,497, filed Apr. 25, 2000.

BACKGROUND-FIELD OF INVENTION

This invention relates to the hammering in of tent stakes that hold a tent in place and then to pull them out using a metal chain with an o-ring attached to it to encircle around the hook of the tent stake, and then to pull the tent stake out of the ground either by using leverage or just simply pulling it out vertically.

BACKGROUND-DESCRIPTION OF PRIOR ART

In recorded history, camping has been a favored past time, and sometimes a way of life in many cultures. From the yurts of China, to the teepees of Native Americans, from the camping tents of the military during the Civil War to the present day leisure tents. Camping tents, until about the 1850's used rocks and trees. But about the 1850's to today, tents have routinely used tent stakes to hold them into the ground. Tents sometimes are hard to put up, especially in very bad weather. At times like these when the tents are being put up, the person who is putting it up sometimes gets distracted and cannot put the tent stake in properly. Sometimes a rock is used to put in the tent stake. But a rock is very bulky and hard to control. It can also, when used, bend and/or render the tent stake useless. A tool needs to be used to safely put in the tent stake, without harming the user or the tent stake itself. Some patents have attempted to do so, like U.S. Pat. No. 3,823,430 to Welsh (1974), however this one is not a universal, nor can it lift the tent stake up vertically in case there is little room for prying it up. U.S. Pat. No. 4,112,530 to Lecce is smaller and is a little bit more universal, yet it will damage the tent stake by scratching it in its V-shaped apparatus. Plus its hammer portion attached to the bottom is a bit awkward and clumsy. U.S. Pat. No. 4,198,719 to Feldpausch is closer to the universal part of being able to pull out any tent stake, but it is limiting because it uses a type of rope to wrap around the tent stake which might break. Some of the tent stakes might not be able to fit around the top of the tent stake hook. Also it has no such feature on it that can show a type of mallet for hammering the tent stake into the ground. The small size of it also does not allow the user to pull up the tent stake with sufficient leverage and allow it to come up with ease as with some other inventions. U.S. Pat. No. 3,867,733 to Verlander is like all of these patents in that it does the job of hammering and pulling out tent stakes, but it is unlike the applicants invention where it cannot be a universal tent stake removing tool and it cannot remove the tent stakes vertically. Also its hammer/mallet portion is very large and and is unlike applicant's invention which is smaller and more precise. It's stake removing tool is also very unlike the applicant's invention which is a metal chain and o-ring, this patent's tool is a small triangular shaped object which removes the tent stake.

The patents of other tent stake hammers have known to suffer from a number of disadvantages, which include:

1.) The inability to be a complete universal stake removal tool, for removing the various shapes and types of tent stakes. Including the ones that have the small hooks.

2.) There has also never been one that is as light weight as mine is or uses such light-weight and durable materials. Such as light-weight plastic for the body tube.

3.) The present inventions lack in the ability to make a starter hole in the ground for the tent stake, so it can go in more easily, or to break up tough and solid ground.

4.) With tent stake removing tools, the inventions have clearly shown the inability to be able to lift out a stake in two or more different ways.

SUMMARY

My invention relates to universal pounding and removing of basically every kind of tent stake, and also the ability to remove the tent stake in any way possible.

OBJECTS & ADVANTAGES

There are many other objects and advantages of my tent stake hammer, described in my patent, besides the ones that were described above in the prior art. The objects and advantages of my invention are:

1.) To provide a tent stake hammer and puller that is a universal tent stake hammer and puller that can hammer in any tent stake and pull out basically any tent stake any possible way.

2.) The invention has a penetrating dibble which can be used to hit the ground to penetrate it to make a starter hole for the tent stake to make pound it in easier.

3.) It has a metal chain with an o-ring attached to it, and makes it easier for the the o-ring to encircle the hook of the tent stake and makes it easier to pull it out.

4.) Because of the flexibility of the wire and the strength of the o-ring that goes around the tent stake, the device is able to remove a tent stake in any position possible that is needed to remove the tent stake properly.

5.) The tent stake hammer and puller is made out of tough materials that makes the invention both strong and light-weight.

6.) The invention may be of any color, because the body-tube is plastic and usually made from a type of mold it has the ability to have differing colors on it besides the normal green color.

Further objects and advantages are to provide for ease of use to the invention and to provide for more power in the swinging and hammering of the tent stakes into the ground, so that they go in faster and are more sturdy in place. Also it will be easier to manufacture and less expensive so it can be supplied in mass so that supply will meet the demand wherever necessary. Other objects and advantages will allow the user to remove the tent stake faster and with less strain and with less use of energy upon the user when removing the tent stake from the ground. Further objects and advantages will be apparent from looking at the ensuing drawings and description.

DRAWING FIGURES

REFERENCE NUMERALS IN DRAWINGS

10.) Hammerhead.
12.) Ground-penetrating dibble.
14.) Plastic Leverage Leg.
16.) Cylindrical plastic body-tube.
20.) Metal socket pin connector.
22.) Metal Chain.
24.) Metal O-ring.
26.) Bottom.
28.) Socket hole for metal connector
30.) Socket pin.

DESCRIPTION

Figure 1:
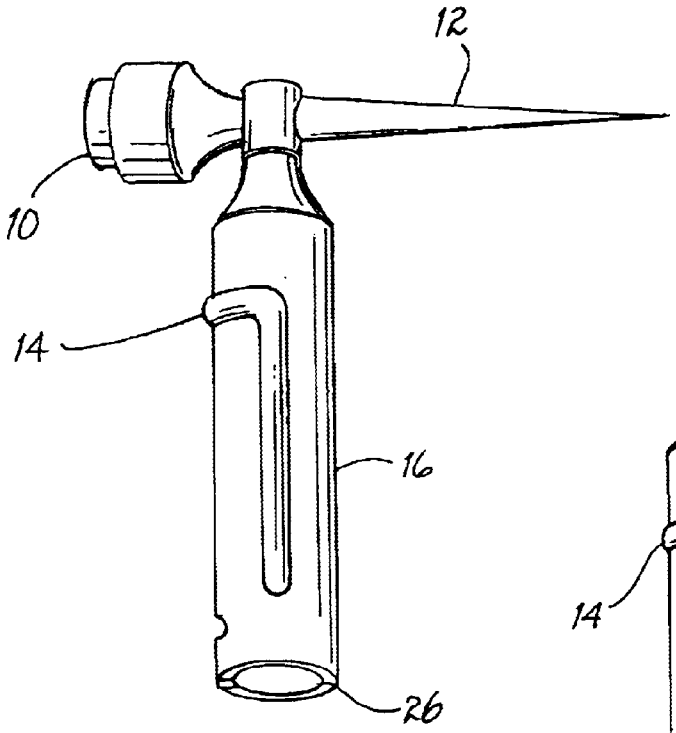
FIG. 1 shows a top view of the invention as seen by a bird.

FIG. 1 shows an overhead view of my invention. The invention comes in two parts, the hammerhead (top part) and the body-tube (lower part). The top part has a ground penetrating dibble 12 which is made out of steel, and has a cylindrical long pyramid shape. Also attached to it is another steel piece which is the general hammerhead portion 10, connected to the main top part. This can also hold the o-ring 24 onto it to hold it in place. The whole upper portion is one thing. The lower portion 16 is made out of plastic and is cylindrical in shape, and is called the body-tube. On the body-tube is the polycarbonite leverage leg 14 which is used when the user wants to pull out the tent stake using only the leverage between him and the ground. The base on bottom of the body-tube 26 or is the end of the cylindrical plastic body tube, and is open to air outside as to allow space for the metal chain 22, and the metal o-ring 24 to be able to be used. Essentially, the entire body tube is hollow on the inside to allow the invention to be as light as it can be. This is also so that the entire upper part can actually fit inside the lower part for storage and easier handling.

Figure 2:
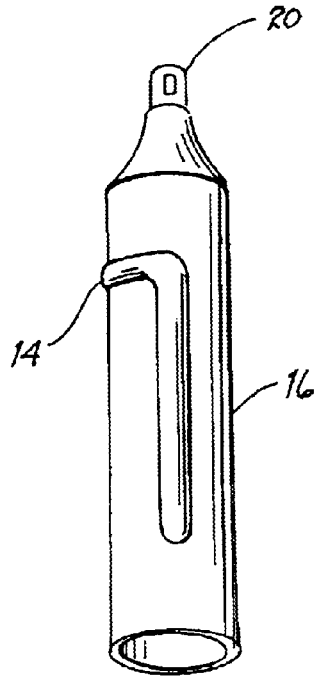
FIG. 2 shows a top view of the lower half of the invention (the body-tube) as seen by a bird.

FIG. 2 shows only the lower part on bottom of the invention, or the bottom part. The invention is split into two pieces as to allow it to be more portable. FIG. 2 shows the plastic body-tube 16, and the polycarbonite leverage leg. It also shows at the top of the lower part the little metal socket pin. This device allows the bottom part to be attached to the top part of the invention, so it turns into the usable device this patent is describing. The body-tube can be made out of materials besides plastic, including metal, wood, fibrous materials, etc.

Figure 3:
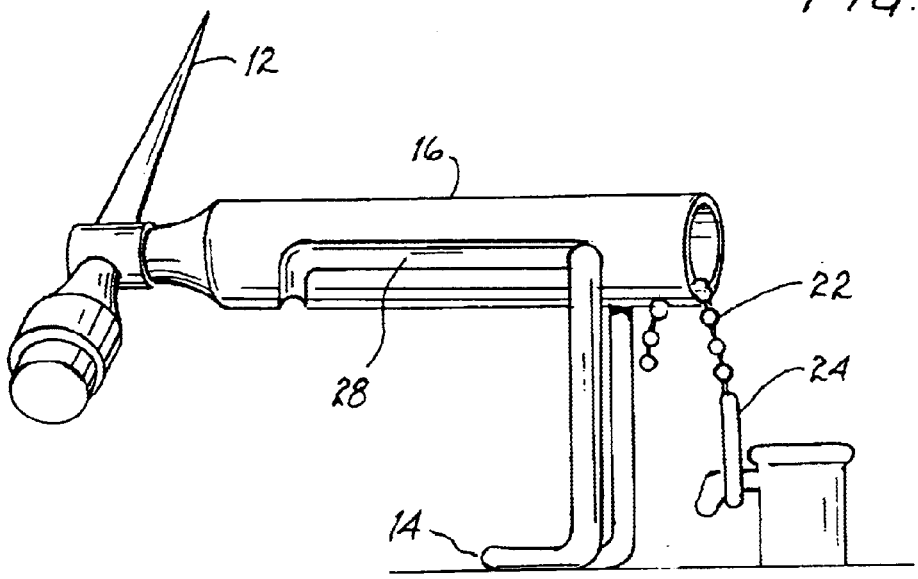
FIG. 3 shows the invention in action pulling out the tent stake, with its leverage leg lowered to provide leverage when pulling the stake out.

FIG. 3 shows the entire invention, put together in action, including not only all the details previously noted in this patent but also, some more information on some other devices. The metal chain 22 is essentially a metal wire with little ball bearings on it to keep it in place on the body-tube. Attached onto the metal chain is the small metal o-ring 24 which is used to go around the hook of the actual tent stake which can either be used to remove the stake from the ground vertically or by using the leverage leg 14 to remove the stake using the leverage force of the user. Also shown is the polycarbonite leverage leg fully extended and is ready to be used to pull out the tent stake using the leverage of the user on the tent stake to pull it out of the ground.

Figure 4:
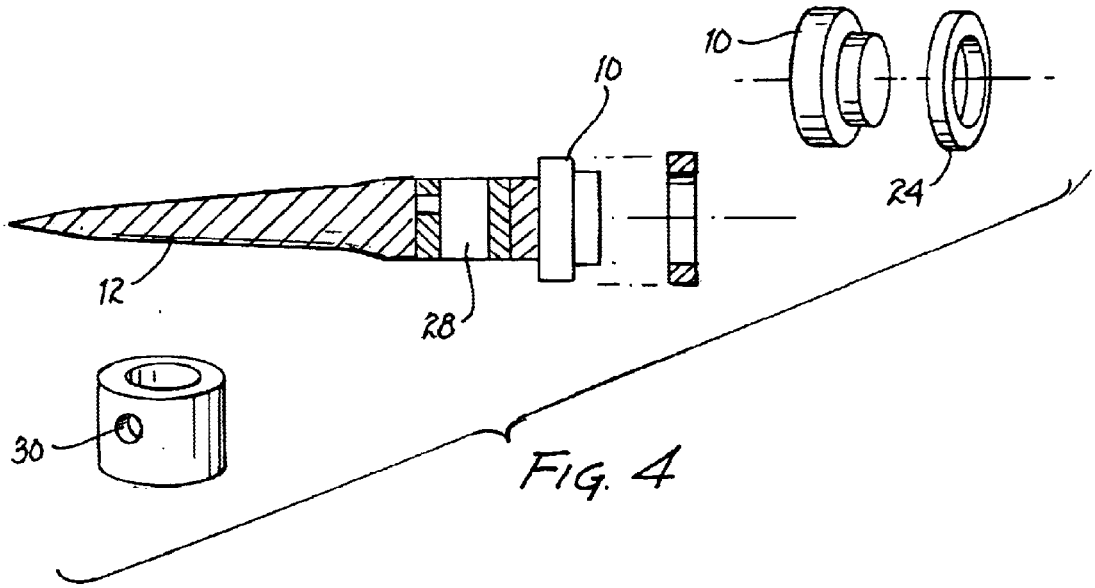
FIG. 4 shows a more detailed version of the top portion of the invention (the hammerhead portion), with all details and objects seen.

FIG. 4 shows the upper part of the invention, including the ground-penetrating dibble 12 and the hammer. The hammerhead is broken up into about two pieces. The hammer itself 10, which is attached onto the main part of the upper half of the invention, and the ring, which is used to go around the hammerhead to make a complete hammerhead. It also shows the section where the metal socket pin connector 20 from the lower part would come up to lock on to the upper part to make the invention into one complete device using a socket pin 30, called the socket hole for the metal connector 28.

The invention is 5.25 inches in length in complete form, and 4.275 inches in width. But it can also be about 8 inches to 4 inches in length, and 6 to 3 inches in total width. The base measures 1.25 inches in length. The lower part is 5.10 inches in length. But it could also be anywhere from 3 to 6 inches in length. While the upper part is 4.275 inches in length and 1.40 inches in width. That could also vary from 2.5 inches to 7 inches in length. The hammerhead is 1.40 inches in diameter and 0.525 inches in height, the ground penetrating dibble is 3.105 inches long. That also could be anywhere from 2.5 to 5 inches in length. The cylindrical body-tube is 3.2 inches in length and 1.25 inches in diameter. The metal socket pin is 1.25 inches in length, and the bottom of the invention is 1.25 inches in diameter. The body-tube could be also anywhere from 2.5 to 6 inches in length, depending on how the other parts fit together. The metal o-ring is 1.40 inches in diameter.

FIG. 3-Additional Embodiments

Additional Embodiments are shown also in FIG. 3. These figures indicate the pulling of the tent stake out of the ground. In one instance, the metal chain that has the small string of metal balls on a metal wire could be strengthened by putting on a stronger high intensity woven wire that attaches onto the o-ring instead of the metal balls-on-wire. Another embodiment would be to make the metal o-ring just a little bit smaller by changing the thickness of it to be able to allow the o-ring to go around smaller and smaller hooks on the tent stakes it removes from the ground.

Figure 5:
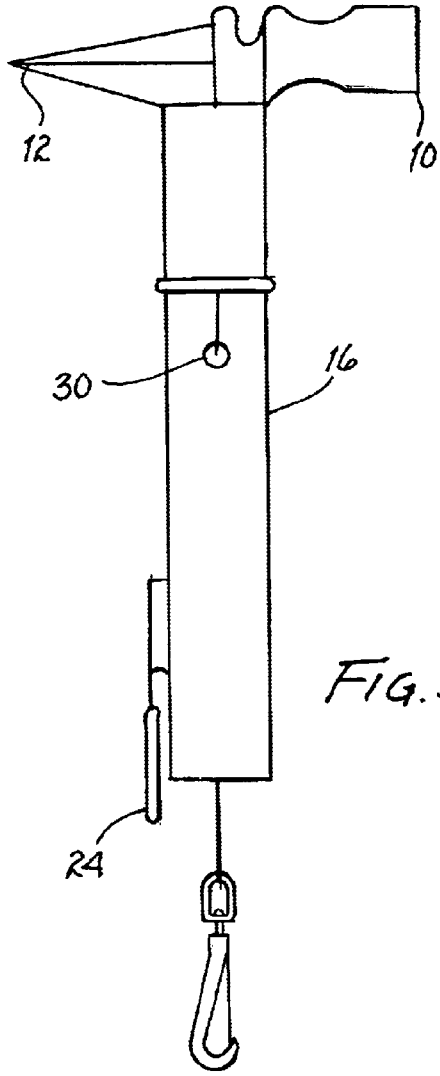
FIG. 5 shows the top view of an additional embodiment of my invention, a longer and larger version with the hammerhead showing and all the details and objects of the invention can be seen as well.

FIG. 5-Alternative Embodiments

Figure 6:
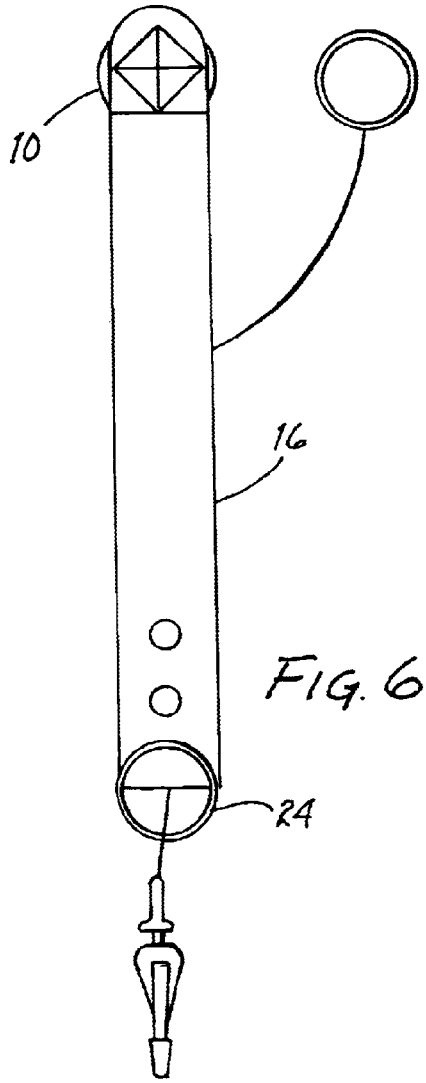
FIG. 6 shows a right-side view of the additional embodiment of my invention.

There are various other possibilities with regard to the pulling out of the tent-stake, as shown in FIG. 5, which is a top view of the alternative embodiment and FIG. 6, which is a right-side view of the alternative embodiment. They both show a way in which the tent-stake could be wrapped around a wire on a snap-hook. Then the snap-hook could be hooked onto a small spherical o-ring, on the lower bottom of the body-tube. Finally by pulling on a larger o-ring, which is attached by a wire to the snap-hook, the wire could then be pulled through the body tube, and the o-ring could then be looped through the ground-penetrating dibble to securely fasten and hold the tent-stake. Then the tent stake could be pulled out of the ground either vertically by holding onto the hammerhead and the ground-penetrating dibble or by using leverage by holding on to the body-tube and pulling out the tent-stake by using the rounded parts on the hammerhead on the ground. You could use Zinc, Aluminum, or Titanium for the head of the invention. You could use a lighter type of metal for the wire that would be used to be attached to the o-ring. The body tube could be made out of wood that could then be hollowed out to make it more sturdy. It could also be made out of metal to make it even more stronger. The body-tube could be lengthened or shortened depending on how much leverage would be needed for more powerful swings. Grooves could be cut into the body tube to show the location of where the best place to put someone's hand when using it. The size of the invention could be lengthened or shortened depending on what is the best size for the usefulness of the invention at that particular time for the user. Larger for more power on the swings and better handling. Or, smaller size for more portability and being able to store it more easily and taking it out more quickly when it comes time to use it in an urgent situation. Finally, invention could be made into one whole part instead of two parts to make it more complete, less complicated to build, and less likely to lose one of the sections.

Advantages

From the description of my invention above, a number of advantages become very evident:

1) The invention is smaller than all the other inventions like mine on the market including the 1974 and 1975 patents.

2) The invention has an ease of use for the hammering in of tent stakes than all of the prior ones.

3) The invention will last longer than the other prior art because it is made of stronger and more durable materials (mainly a polyurethane & steel construction).

4) The invention is different from all the other inventions because for a tent-stake tool it is the first that has a hole-maker on one end and it is the first tent-stake tool that is a universal tent stake tool.

5) The invention operates with better precision than the other prior art because of all the uses it has.

6) There is a trend of demand for my invention type because people are going camping a lot more than they used to because it is so inexpensive.

7) The invention is better than all the other prior art out there because unlike the other inventions which can only work for a specific tent stake, mine is universal tent stake remover, which can work for all regular sized hooks for the tent stakes.

8) Just like the other prior art, my invention is likely to sell at an acceptable level.

9) The invention is safer than all the other inventions because its portability means that it will be less bulky and also because it can be broken up into two parts, which also makes it more portable.

10) The invention unlike all the other prior art, is easier to distribute because it is more durable and not as fragile as the other ones and is stronger.

11) The invention is better than all the other prior art on the market because, it has three functions for the use of camping, instead of having just one or two functions 12) The invention has a technical advantage over the other prior art.

Operation-FIG. 3

The manner of using the invention to hammer in tent stakes is quite simple. First, make a sufficient starter hole which is really useful in extremely hard and dry ground. Also if you have to, to break up the hard ground into easier using ground. First you hold the invention by the cylindrical body tube 16, and then pound the ground penetrating dibble 12 forcefully into the hard ground and either make the starter hole or breaking up the hard ground. Then, you would take the tent stake and try to steady it where you want to hammer it in. Then, you hold the invention by the plastic cylindrical body tube 16, and then make the hammerhead 10 make contact with the tent-stake and drive it into the ground.

But before any of that, you must first put the invention together, from two parts into one. First you take the lower portion and the upper portion in your hands. Then, you take the lower portion and put the metal socket pin connector 20 and put it into the socket hole connector 28 in the upper portion. Then, you put the actual socket pin 30 into the socket pin connector 20 going through the socket hole connector 28 in the top part holding to the lower part and the upper part together of the invention firmly together.

When you are ready to take the tent stake out, you have two choices. If you want to take the tent-stake out vertically, you first take the metal o-ring 24, which is attached to the metal chain 22 and attach it to the bottom attachment area and decide what length you want the metal chain 22 and put it around the hook of the tent stake. Then, you hold the invention by putting one finger around the ground penetrating dibble 12 and the other finger around the hammerhead 10 and pulling up on it and therefore pulling the tent stake out vertically.

Alternately, you could pull out the tent stake out using leverage. First you put the o-ring 24 around the the hook of the tent stake. Then you pull the leverage leg 14 out of the cylindrical body tube 16 and have it on the ground. Then, you apply force on the invention on the upper portion downwards towards the ground. Because of this force, the tent stake comes out of the ground. Then, you flip the leverage leg 14 back onto the body-tube, and take the tent stake off the o-ring and put the tent stake away.

Conclusion, Ramifications, and Scope

Accordingly, the reader will see the tent-stake hammer can be used to make a starter hole for the tent stake, hammer it in, and to remove it with great ease, and convenience, without putting too much stress on the user, damaging the tent stake, and saving a lot of useful time. Though my description shows a very clear description, these should not be limitations on the scope of my invention but rather as one of the many uses that it has, one of the most important and preferred embodiments. Other variations and additional advantages that are possible of what this invention could be used for. For example, the invention could also be used as follows:

a) A pick for soft ground.

b) A hammer for hammering different objects into other objects such as tacks, small nails, into wood or cloth of some sort.

c) Using the circular long shaped end to plow the ground for seeding and planting.

d) Using the circular long shaped end as a weapon against an attacker (in the the woods it could be used against a ferocious animal).

e) The o-ring on the bottom of the tool can be used to hang the tool on a wall on a peg or the like, when the o-ring's metal chain is attached to the invention itself at the time.

f) The leverage leg could be used to scoop up dirt, sand, or the like by using it's scoop-like shape.

g) The upper portion, when used alone, could be put into the ground by the ground penetrating dibble to be used as a marker for something.

h) The lower portion, when used alone, could be used to hold pencils, pens, or the like inside of the body-tube for storage, when it is not holding the upper portion in it.

i) The socket pin could be used to mark something in the ground.

j) The socket pin could be used to hold something in a soft type of material.

k) The o-ring could be used to attach on something, then to have the metal wire, with the ball bearings attached to it, be tied to another thing like a door to keep the door shut.

Therefore the scope of the invention should not be determined by the description above, but as merely providing an example of some of the preferred embodiments of this particular invention. For example, the o-ring could not only be a circular shape, but also could be triangular, oval, diamond, rectangular, etc.

Thus, the invention's scope should not, once again be determined by the examples given, but rather by the appended claims, and their legal equivalents.

I claim:

1. A camping tool comprising:

a) an upper portion with a hammer on one side and a ground penetrating-dibble on the other side, and b) a lower portion with an o-ring attached to it by a metal chain to remove a tent-stake.

2. A camping tool in accordance with claim 1 wherein said upper portion and said lower portion are coupled together with a pin.

3. A camping tool in accordance with claim 1 wherein said lower portion has a curved member which is swung in a downward motion as a leverage device to pull the tent stake out.

4. A camping tool in accordance with claim 1 wherein the ground penetrating dibble is used to form a starter hole for the tent stake by striking the dibble into the ground to break up the ground.

* * * * *